US005181833A

United States Patent [19]

Villa et al.

[11] Patent Number: 5,181,833

[45] Date of Patent: Jan. 26, 1993

[54] PORTABLE PUMP SYSTEM

[75] Inventors: Cindy S. Villa; Johnny Villa, Jr., both of Andrews, Tex.

[73] Assignee: Atlantic Richfield Company, Los Angeles, Calif.

[21] Appl. No.: 716,451

[22] Filed: Jun. 17, 1991

[51] Int. Cl.[5] ..... F04B 21/00

[52] U.S. Cl. ..... 417/234

[58] Field of Search ..... 417/234, 393

[56] References Cited

U.S. PATENT DOCUMENTS 1,765,806 4/1930 Beach ..... 417/234

4,872,816 10/1989 Fetcko ..... 417/234

*Primary Examiner*—Ricard A. Bertsch

*Assistant Examiner*—Alfred Basichas

*Attorney, Agent, or Firm*—Roderick W. MacDonald

[57] ABSTRACT

A combined fluid pumping and storage system which is readily portable and employs a compressed gas operated pump together with a liquid container on a vehicle, the vehicle also carrying at least one compressed gas supply for operating the pump whereby the vehicle is easily transported to a site where liquid is to be picked up for transporting elsewhere and can be operated safely in all conditions including potentially flammable conditions.

2 Claims, 3 Drawing Sheets

PORTABLE PUMP SYSTEM

BACKGROUND OF THE INVENTION

Heretofore, when necessary to pump liquid from a sump or other immovable container, combined mobile pump and container systems have been employed. However, in these systems the power source to run the pump for removing the liquid from the sump and pumping it into the moveable container has either been an electrically operated pump or one that is powered by an internal combustion engine.

In the oil patch or in other industrial situations where flammable liquids and, sometimes explosive gases are present, such pumping systems are not desirable because the electrical motors or internal combustion engines can serve as an ignition source for the liquid being pumped as well as any explosive gas that may be in the atmosphere.

Thus, it is highly desirable to have a pumping system with its own mobile container that is also free of ignition sources.

SUMMARY OF THE INVENTION

According to this invention there is provided a combined mobile fluid pumping and storage system which carries its own pump in combination with one or more mobile liquid containers wherein the pump is a compressed gas operated diaphragm pump and one or more compressed gas sources are carried along with the fluid pumping and storage system. The compressed gas operated diaphragm pump is operably connected to the compressed gas supply means in a manner such that the compressed gas being supplied to the pump can be varied in pressure to meet any particular pumping demand.

There is also employed in accordance with this invention special means for tightly securing the compressed gas supply means to the vehicle which transports the fluid pumping and storage system so that the compressed gas supply means are rigidly secured in place and at least the gas supply end of the compressed gas supply means is protected from accidental impacts or blows from an external source while the vehicle is in transit or in pumping use.

Accordingly, it is an object of this invention to provide a new and improved apparatus for vacuum pumping. It is another object to provide a new and improved apparatus for pumping in a safe manner a flammable liquid even in a potentially explosive atmosphere. It is another object to provide a new and improved apparatus for combined fluid pumping and storage without reliance upon any power system that can serve as an undesired ignition source. Other aspects, objects and advantages of this invention will be apparent to those skilled in the art from this disclosure and the appended claims.

DETAILED DESCRIPTION OF THE INVENTION

Figure 1:
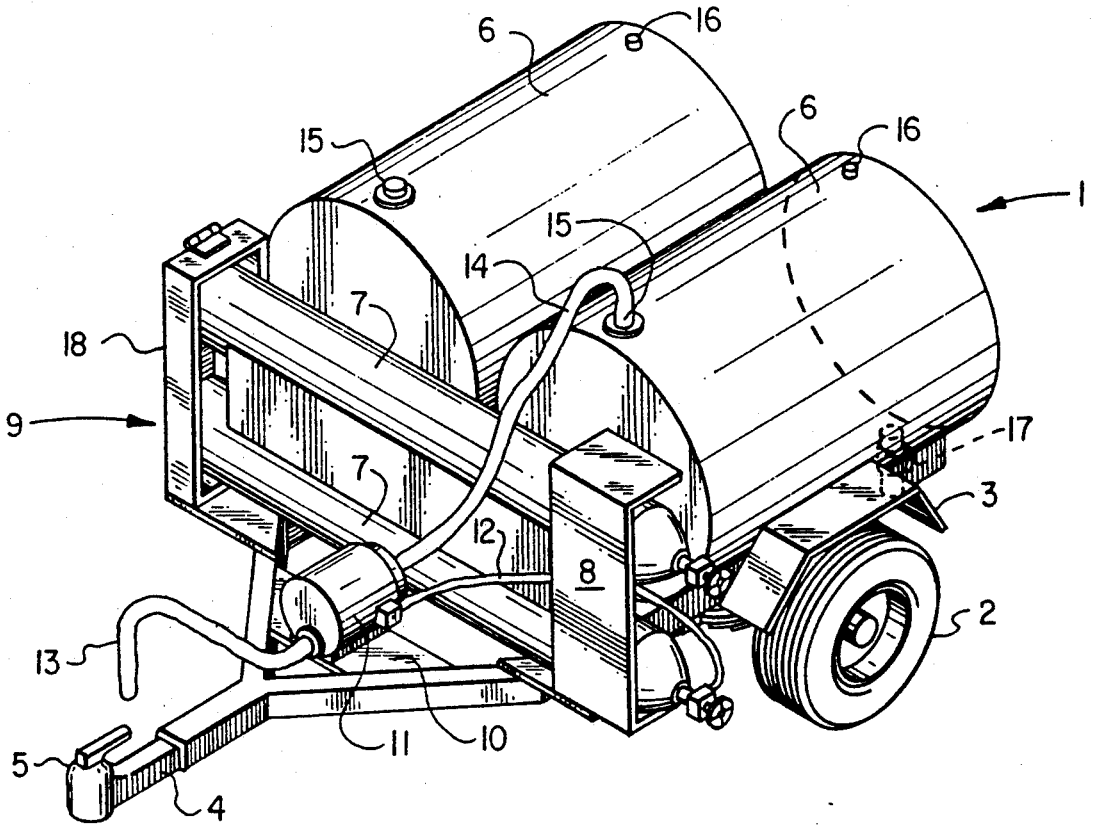
FIG. 1 is an isometric view of one vehicle fitted out in accordance with this invention.

In FIG. 1 there is shown a conventional trailer means 1, although other conveyance means are useful in this invention such as motor vehicles and the like, which is supported by wheels 2 that are protected by fenders 3. A conventional draw bar 4 extends from trailer 1 for hooking the trailer to any desired motor vehicle be it a truck, car, tractor, or the like by way of standard trailer hitch 5. Trailer 1 carries a pair of liquid container means 6 in side-by-side relationship with their long axes parallel to the long axes of trailer 1. In lieu of a pair of container means 6, the conveyance means employed can carry a single liquid container or more than two as shown in FIG. 1 depending upon the operator's desire and the applications in which the trailer is to be used. For example, when it is desired, for an environmental or other purposes, to keep liquids segregated, the dual container system of FIG. 1 is quite useful. If liquid segregation is not important, a single container on trailer 1 can yield more carrying capacity for the same size trailer.

In front of liquid container means 6 a pair of compressed gas source means 7 are carried which are individual containers that can either be operably connected so as to jointly supply compressed gas or can be left separate so that each individual container is used as a compressed gas source in turn and separate from each other. Compressed gas means 7 are each protected at their gas outlet end by baffle means 8 and are tightly secured to trailer 1 by locking apparatus 9 which will be described in greater detail hereinafter with respect to FIGS. 3 and 4.

Ahead of compressed gas means 7 a base plate 10 is carried on draw bar 4 for supporting a compressed gas operated diaphragm pump means 11. Pump 11 is operated by passing compressed gas from either or both of gas sources 7 through the pump on one side of a moveable diaphragm as is well known in the pumping art. As also well known, such diaphragm movement creates a vacuum at the inlet port 11' of pump 11 and forces liquid out the pump through the outlet port 11" of pump 11 to the desired receptacle 6 for such pumped liquid. Pump 11 can be any conventional diaphragm pump well known in the art and commercially available, for example, a Sandpiper pneumatic diaphragm pump manufactured by the Warren Rupp Company of Mansfield, Ohio.

First conduit means 12 is a compressed gas conduit or flow line operably connected to the compressed gas outlet end (shown in FIG. 3) of at least one of compressed gas sources 7 and at its opposing end to pump 11 so that gas metered from supply 7 through a conventional regulator means for desired pressure regulation passes to pump 11 and operates the diaphragm pumping mechanism therein in a conventional manner.

The inlet or vacuum port 11' of pump 11 is connected to second conduit means 13 which is used to remove liquid from its current or undesired resting place to the outlet end 11" of pump 11 and from outlet end 11" passes by way of third conduit means 14 into container 6.

Accordingly, pump 11 is operated without resort to any electrical or combustion power means which can serve as an undesired ignition source.

The outlet end of third conduit means 14 is connected to an inlet port 15 of at least one of container means 6, both container means 6 carrying conventional vent means 16 for venting vapor to the atmosphere should an undesirably high pressure be achieved within a container means 6. Each container means 6 has a valved unloading pipe 17 for removing liquid from the interior of the container after trailer 7 has been transported to the desired unloading location.

Thus, liquid can be picked up by way of second conduit means 13 from any location such as a collecting sump or even from an undesired leak or spill after or during the leak or spill occurrence because vehicle 1 is easily and readily transportable, even into congested areas.

Although there are major safety advantages for the pumping system of this invention from an ignition point of view, the safety advantages do not stop there. For example, there are no external moving parts to the system of this invention as there would be if other types of pumping systems were employed so there is a safety feature to the system of this invention even when a nonflammable liquid is being pumped and when no explosive gasses are present in the atmosphere. Further, diaphragm pumps can be obtained which pump a high volume of liquid and which will handle sandy or thick liquids such as weathered crude oil or water-hydrocarbon sludges, and can even handle up to two-inch diameter solid pieces of material. This can be achieved in addition to pumping liquids of normal viscosity or even light fluids such as condensate liquids from natural gas. Further, diaphragm pumps can be obtained that run on very low compressed gas pressure so that high pressure compressed gas source means 7 are not necessary in order to eliminate the need of an air compressor to power pump 11. Accordingly, conventional compressed gas pressures can be employed in the system of this invention which is yet another safety feature for this invention. For example, compressed gas sources 7 need not hold compressed gas at a pressure over 2000 psig and can even be used with lower than 2000 psig compressed gas because diaphragm pump 11 can, depending upon the particular pumping application, be made to operate on compressed gas of a pressure of from about 10 to about 200 psig, preferably from about 50 to about 100 psig. Further safety features for the system of this invention are a demonstrated low maintenance requirement in part because of a lack of moving parts, and a low noise level during operation. Container 6 can be formed of any desired material but is preferably composed of see-through fiberglass so that the level 43 (FIG. 4) of the liquid 44 inside container 6 can be viewed by the operator at a glance from any position outside container 6 which is yet another safety feature of this invention.

The pressure of the powering compressed gas can be regulated at the outlet end (FIG. 3, 7') of the compressed gas supply means and/or in first conduit means 12 and/or at pump 11 or any combination thereof thereby giving an essentially infinite adjustability for compressed gas pressure as it arrives at the pump for speeding up and slowing down the pumping action. For example, by speeding up the pump, and therefore the pumping action, the system of this invention can pick up a leaking fluid almost as fast as it leaks out thereby minimizing potential environmental damage and can do so in a safe manner even in a potentially flammable atmosphere.

The system of this invention can be used for many pumping applications, for example, in the oil patch it can be used to blow down oil well flow lines, pick up collections of liquids at remote locations in the oil field, and has resulted in a lowering of clean-up costs on oil field leases. All this is in addition to increasing the safety of the operations on those leases.

Figure 2:
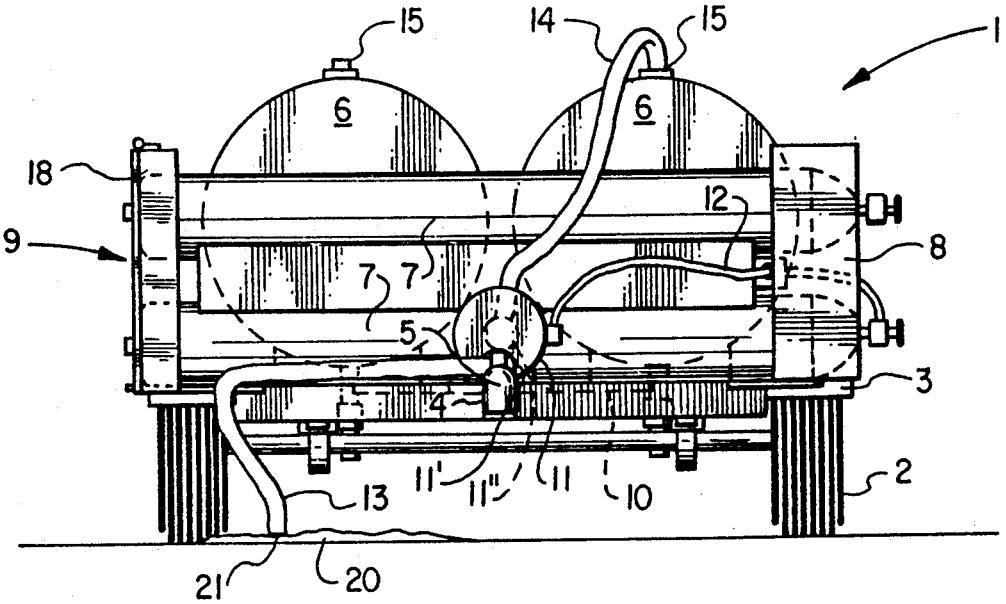
FIG. 2 is a front view of the vehicle of FIG. 1.
Figure 3:
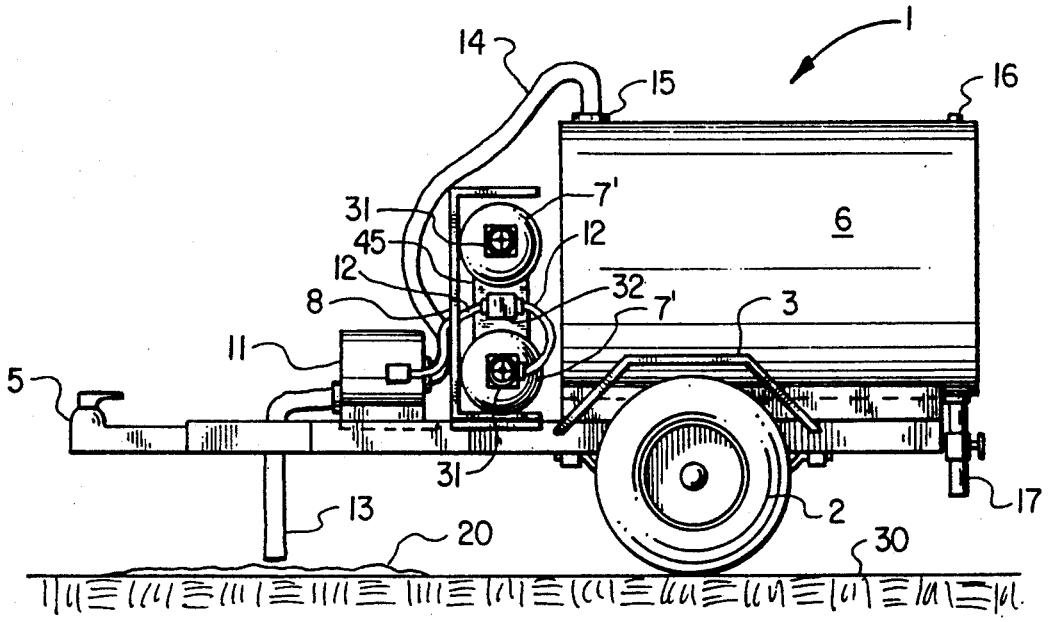
FIG. 3 is a left-side view of the vehicle of FIG. 1.

FIG. 2 is a front view of the system of FIG. 1 in use for picking up a small oil spill 20 on the surface of the ground 30 (FIG. 3). In this application, the inlet end 21 of second conduit means 13 is immersed in the spilled liquid 20. Compressed gas such as air is fed by way of first conduit means 12 into pump 11 to cause the operation of the pump whereby liquid 20 is pulled by vacuum through second conduit means 13 into the inlet port 11' of pump 11 and out the outlet port 11" into third conduit means 14 and thence into the interior of container 6.

FIG. 3 shows liquid spill 20 to be of limited extent and to be on the surface of the earth 30. If the source of leak 20 is still supplying liquid, the pressure of compressed air in conduit means 12 can be adjusted so as to operate pump 11 so that liquid 20 is picked up into second conduit means 13 as quickly as the leak source feeds pool 20. FIG. 3 also shows the compressed gas supply ends 7' of compressed gas supply means 7.

It can be seen from FIGS. 2 and 3 that a compressed gas supply means such as a pair of cylindrical compressed air tanks 7 are carried in a side-by-side relation on vehicle 1 with the compressed gas outlet ends 7' adjacent to one another, each outlet end 7' carrying a conventional valved outlet means 31. In the case of FIG. 3 lower tank 7 has fixed to its gas outlet means 31 a conventional gas pressure regulator means 32 which can be used to vary the pressure of the gas flowing into first conduit means 12 and, therefore, flowing into and operating pump 11. FIG. 3 also shows that baffle means 8 shields or otherwise protects the front side of gas supply ends 7' as well as the top and bottom thereof, i.e., baffle means 8 shields the front, top, and bottom of the outlet ends of all compressed gas tanks carried on vehicle 1.

Figure 4:
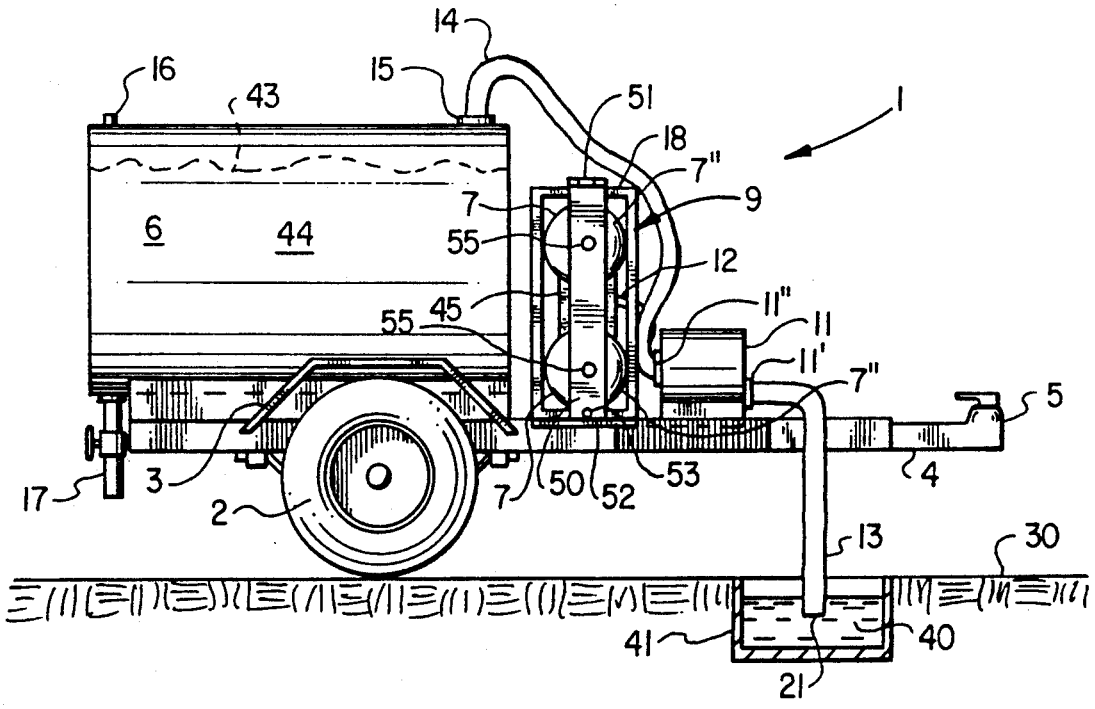
FIG. 4 is a right-side view of the vehicle of FIG. 1.

FIG. 4 shows the right side of the vehicle of FIG. 2 when used to remove liquid 40 from a sump 41 set into the earth below earth's surface 30 to demonstrate yet another application for the system of this invention.

FIG. 4 also shows locking apparatus 9 by which compressed air tanks 7 are tightly but removably secured to trailer 1. The lower tank rests upon the trailer itself and has nested above it spacer 45 upon which rests upper tank 7. While the gas outlet ends 7' of both tanks 7 can readily be fixed in place by a non-removable plate 60 (FIGS. 5, 7, and 8) that is rigidly fixed to trailer 1 and has upper and lower apertures therein so that ends 7' can be slid through an aperture so the plate holds that end of the tanks tightly in place, locking apparatus 9 is used to secure the ends 7" of tanks 7 which are opposite to the outlet ends 7' in a manner such that tanks 7 can be removed from trailer 1 when empty and new full tanks put in their place. It can be seen in FIG. 4 that apparatus 9 is composed of a frame member 18 which encloses the sides of tanks 7 and top of the upper tank when in place in their side-by-side, vertically stacked relationship shown in FIG. 4. However, opposing ends or bottoms 7" are only covered, at least in part, by an elongate locking member 50 which extends the full height of frame 18 and the full height of both tanks 7 as stacked on trailer 1. Locking member 50 has first and second ends with the first or upper end being pivotly connected to frame 18 by way of hinge means 51 thereby leaving second or lower end 52 free swinging toward and away from ends 7''. Second end 52 carries a locking device 53 so that when end 52 is moved into contact with draw bar 4 or any other rigid part of trailer 1 end 52 can be securely, physically locked to draw bar 4 thereby securely fixing ends 7'' within frame 18 against vertical or horizontal movement and elongate locking member 50 against lateral movement parallel to the longitudinal axes of tanks 7.

Elongate locking member 50 also carries spaced along the length thereof rotatable screw or other conventional means 55 which are movable toward and away from ends 7'' for tightly engaging each of tanks 7 once free swinging end 52 is fixed to draw bar 4 by way of locking device 53. Locking device 53 can be any conventional device well known in the art for physically fixing a moveable member (50) to a rigid member (draw bar 4) in a removable manner. This can even include for example, a conventional nut and bolt arrangement.

Thus, gas supply ends 7' of tanks 7 can be fixed against vertical, horizontal and lateral movement by way of a combination of a conventional perforated plate at the gas supply end (FIG. 3) and locking apparatus 9 at ends 7'' which are opposite to said outlet ends 7'.

Figure 5:
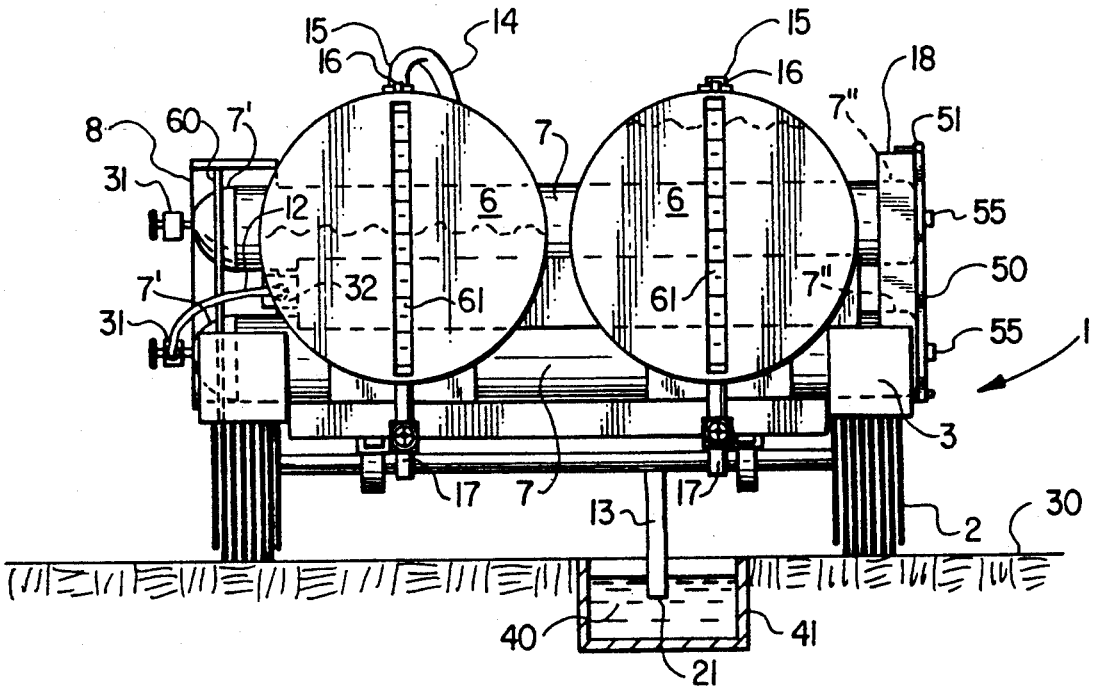
FIG. 5 is a rear view of the vehicle of FIG. 1.

FIG. 5 shows a rear view of the apparatus in use as shown in FIG. 4 and additionally shows that the back ends of both of containers 6 can carry externally visual liquid level means or gauges 61 for ease of determining the volume of liquid contained in the interior of either of containers 6 when containers 6 are composed of see-through fiberglass. In addition, FIG. 5 shows perforated plate 60 through which ends 7' of each of tanks 7 extend for rigidly securing ends 7' of both tanks 7 to vehicle 1 as described aforesaid.

Figure 6:
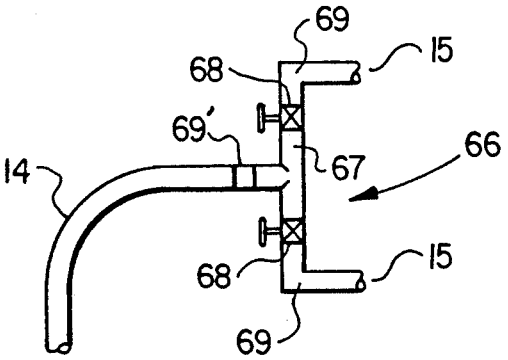
FIG. 6 is a manifold system useful with the vehicle of FIG. 1.

FIG. 6 shows a conventional manifold means 66 that can be employed when two or more containers 6, in the case of FIG. 6, are carried on trailer 1. In the case of FIG. 6 manifold means 66 is composed of a "T" member 67 with opposing ends of the T-top carrying valve means 68 and with the T-leg carrying a conventional connector 69 which connects to third conduit means 14. A pair of conduit means 69 extend from each valve means 68 to connect with inlet ports 50 of each of tank containers 6. Similar manifold means can be employed at outlet ends 17 of tanks 6 if desired.

Figure 7:
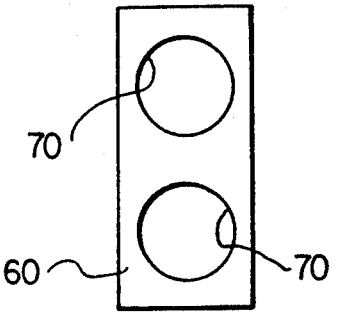
FIG. 7 is a front view of a perforated plate for holding one end of a pair of compressed gas tanks.

FIG. 7 shows perforated plate 60 to have a pair of upper and lower perforations for receiving and holding outlet ends 7' of a pair of gas tanks 7. Each perforation 70 has a diameter larger than the small tapered end of tanks 7 but smaller than the full diameter of such tanks.

Figure 8:
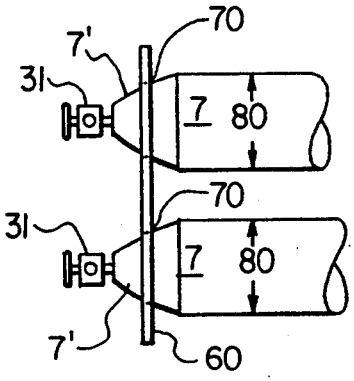
FIG. 8 is a side view of the plate of FIG. 7 with a pair of tanks in place.

FIG. 8 shows a side view of plate 60 with tanks 7 in place as they would be on trailer 1 as shown in FIG. 5. FIG. 8 also shows in better detail the tapered outlet ends 7' which pass through perforations 70 but not all the way through because full diameter 80 of tanks 7 is larger than the diameter of perforations 70.

Reasonable variations and modifications are possible within the scope of the disclosure without departing from the spirit and scope of this invention.

What is claimed is:

1. In a vehicle for transporting a combined fluid pumping and storage system wherein a pump means carried by said vehicle is employed to pump fluid from a source external to said vehicle into at least one storage means carried by said vehicle, the improvement comprising said pump means is a compressed gas operated diaphragm pump having inlet and outlet ports, said diaphragm pump means being driven by compressed gas so as to create a vacuum at said inlet port to pick up fluid from said external source and deliver said picked up fluid to said outlet port for further transport of said fluid to the interior of said storage means, at least two compressed gas supply means each having a compressed gas outlet end and carried by said vehicle in side-by-side relation with their compressed gas outlet ends adjacent to one another, first conduit means operably connecting said outlet end of said compressed gas supply means to said diaphragm pump means to operate said pump means, regulator means carried by at least one of said diaphragm pump means, said compressed gas supply means or said first conduit means for varying the pressure of the compressed gas employed to operate said diaphragm pump means, means for tightly but removably securing said compressed gas supply means to said vehicle at the end of said gas supply means which is opposite to said compressed gas outlet ends by way of an elongate locking member having opposing first and second ends, said first end of said locking member being pivotally connected to and carried by said vehicle, said second end of said locking member being free swinging toward and away from said gas supply means, said locking member when in its locked position covering at least part of said end of said gas supply means which is opposite to said compressed gas outlet ends of said gas supply means, said locking member carrying at its second free swinging end a locking device for fixing said free swinging end of said locking member to said vehicle, and rotatable screw means threadably carried by said locking member for tightly engaging each of said gas supply means once said free swinging end of said locking member is fixed to said vehicle by way of said locking device, baffle means surrounding at least part of the front, top and bottom of said outlet ends of said compressed gas supply means to protect said outlet ends from impact by an outside source, second conduit means operably connected to said inlet port of said diaphragm pump means for picking up fluid from said external source, and third conduit means operably connecting said outlet port of said diaphragm pump means to the interior of said storage means.

2. The apparatus according to claim 1 wherein said compressed gas supply means is compressed air supply means.

* * * * *